US011173713B2

(12) United States Patent
Sato et al.

(10) Patent No.: US 11,173,713 B2
(45) Date of Patent: Nov. 16, 2021

(54) LIQUID DISCHARGE HEAD

(71) Applicant: CANON KABUSHIKI KAISHA, Tokyo (JP)

(72) Inventors: Tomohiro Sato, Tokyo (JP); Koichi Ishida, Tokyo (JP); Masaki Oikawa, Inagi (JP); Yoshinori Misumi, Tokyo (JP); Maki Kato, Fuchu (JP); Yuzuru Ishida, Yokohama (JP); Tsubasa Funabashi, Oita (JP)

(73) Assignee: Canon Kabushiki Kaisha, Tokyo (JP)

( * ) Notice: Subject to any disclaimer, the term of this patent is extended or adjusted under 35 U.S.C. 154(b) by 59 days.

(21) Appl. No.: 16/828,733

(22) Filed: Mar. 24, 2020

(65) Prior Publication Data

US 2020/0316941 A1 Oct. 8, 2020

(30) Foreign Application Priority Data

Apr. 4, 2019 (JP) ..... JP2019-072251

(51) Int. Cl.
*B41J 2/14* (2006.01)
*B41J 2/175* (2006.01)
*B41J 2/155* (2006.01)

(52) U.S. Cl.
CPC ..... *B41J 2/14048* (2013.01); *B41J 2/1404* (2013.01); *B41J 2/14072* (2013.01); *B41J 2/17556* (2013.01); *B41J 2/155* (2013.01)

(58) Field of Classification Search
CPC .. B41J 2/14048; B41J 2/1404; B41J 2/14072; B41J 2/17556
See application file for complete search history.

(56) References Cited

U.S. PATENT DOCUMENTS

2008/0024563 A1* 1/2008 Matsui ..... H01L 41/0805 347/70
2011/0074252 A1* 3/2011 Kura ..... H01L 41/319 310/364

FOREIGN PATENT DOCUMENTS

JP 2007-160624 A 6/2007

* cited by examiner

*Primary Examiner* — Lamson D Nguyen
(74) *Attorney, Agent, or Firm* — Canon U.S.A., Inc., IP Division

(57) ABSTRACT

A liquid discharge head includes a flow passage forming member, an element substrate including a liquid discharge element and a surface on which a conductive member made from a metallic material is disposed, and an intermediate layer made from a resin material and configured to join the flow passage forming member and the surface of the element substrate to each other. The intermediate layer is disposed in a state, separated from the conductive member, where the conductive member is exposed from the intermediate layer. The conductive member is covered with the flow passage forming member.

15 Claims, 10 Drawing Sheets

LIQUID DISCHARGE HEAD

BACKGROUND OF THE DISCLOSURE

Field of the Disclosure

The present disclosure relates to a liquid discharge head that discharges liquid.

Description of the Related Art

Liquid discharge heads such as inkjet recording heads include an element substrate and a flow passage forming member. The element substrate includes a liquid discharge element, such as a heating element, that discharges a liquid. The flow passage forming member forms a discharge port and a flow passage. With the aim of preventing separation between the element substrate and the flow passage forming member made from a resin material, Japanese Patent Application Laid-Open No. 2007-160624 discusses a configuration in which an adhesion layer (an intermediate layer) made from a resin material highly adhesive between the element substrate and the flow passage forming member is disposed between them.

In recent years, there have been growing demands on the liquid discharge heads for improvement in image quality, achievement in multifunctionality, enhancement in durability, and the like. The liquid discharge heads have been equipped with discharge ports, circuits, and the like at a high density to meet the improvement in image quality. The liquid discharge heads also have been equipped with a circuit having various functions to meet the achievement of multifunctionality. According to such demands for increase in the density and the achievement of multifunctionality, the liquid discharge heads may include a conductive member for disposing a circuit on a surface of the element substrate on a side where the flow passage forming member is disposed.

In the above described configuration, the conductive member may be covered with an intermediate layer made from a resin material to prevent the conductive member mounted on the surface of the element substrate from corroding resulting from adhesion of a liquid. However, the conductive member made from a metallic material is less adhesive to the intermediate layer made from the resin material, and therefore the intermediate layer may be detached or separated from the conductive member. Starting from a detached and separated portion, further separation between the element substrate and the flow passage forming member can be occurred. Especially when the conductive member is made from a material containing gold, a possibility of occurrence of separation is increased since the conductive member is less adhesive to the intermediate layer.

SUMMARY OF THE DISCLOSURE

Therefore, the present disclosure is directed to preventing separation between the element substrate and the flow passage forming member while protecting the conductive member mounted on the surface of the element substrate from a liquid.

According to an aspect of the present disclosure, a liquid discharge head includes a flow passage forming member that is made from a resin material and forms a flow passage in communication with a discharge port, an element substrate including a liquid discharge element configured to discharge a liquid from the discharge port, and a surface, on a side where the flow passage forming member is disposed, on which a conductive member made from a metallic material is disposed, and an intermediate layer made from a resin material and configured to join the flow passage forming member and the surface of the element substrate to each other, wherein the intermediate layer is disposed in a state, separated from the conductive member, where the conductive member is exposed from the intermediate layer, and wherein the conductive member is covered with the flow passage forming member.

Further features of the present disclosure will become apparent from the following description of example embodiments with reference to the attached drawings.

DESCRIPTION OF THE EMBODIMENTS

In the following description, a first example embodiment of a liquid discharge head 5 according to the present disclosure will be described. The present disclosure shall not be limited to the example that will be described below. It is also possible to employ a configuration configured like a combination of each of the present example embodiment and example embodiments that will be described below.

(Example Recording Apparatus)

Figure 1:
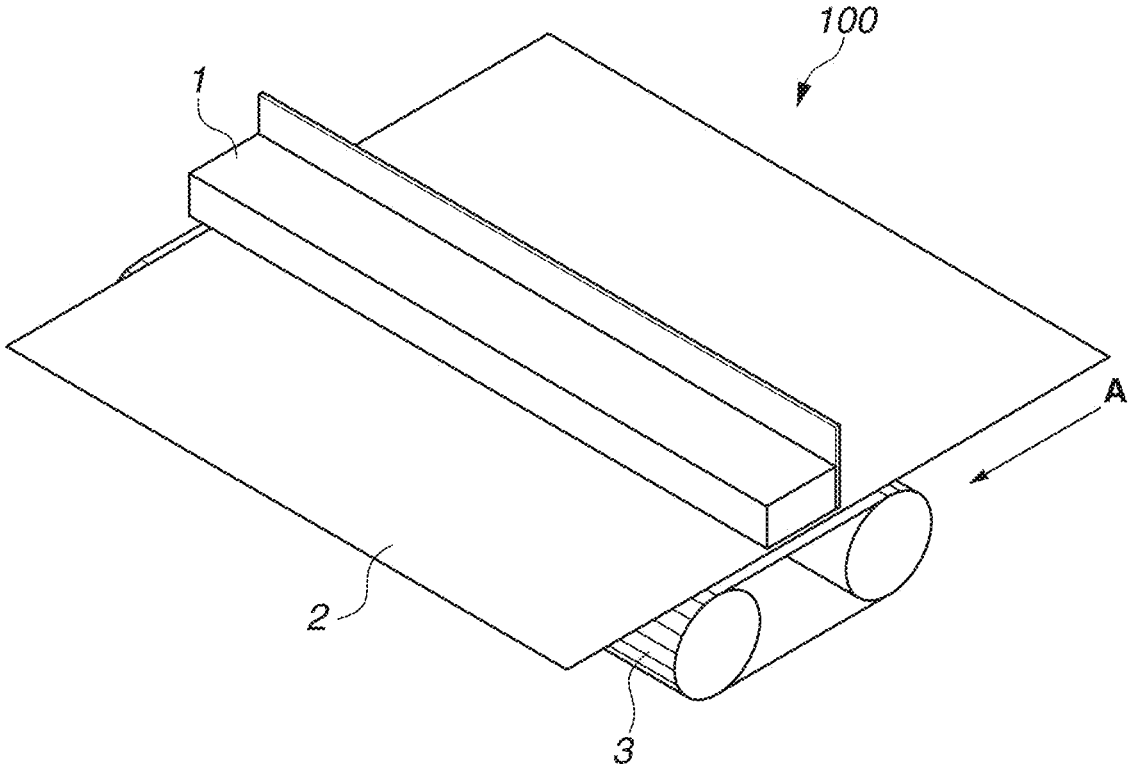
FIG. 1 is a perspective view illustrating an example recording apparatus.

First, FIG. 1 is a diagram illustrating an example of a liquid discharge apparatus 100 (an inkjet recording apparatus) to which the present disclosure is applicable. FIG. 1 illustrates an example of a full line-type liquid discharge apparatus on which a liquid discharge head unit 1 including discharge ports arrayed along an entire width of a recording medium is mounted. A recording medium 2 is conveyed by a conveyance unit 3 in a direction indicated by an arrow A, and is subjected to recording by receiving a liquid discharged from the liquid discharge head unit 1. FIG. 1 illustrates an example of the liquid discharge apparatus 100, and the present disclosure is also applicable to a different configuration and, for example, may be applied to a recording apparatus on which the liquid discharge head unit 1 scans in a direction intersecting a direction in which the recording medium 2 is conveyed.

(Example Liquid Discharge Head Unit)

Figure 2:
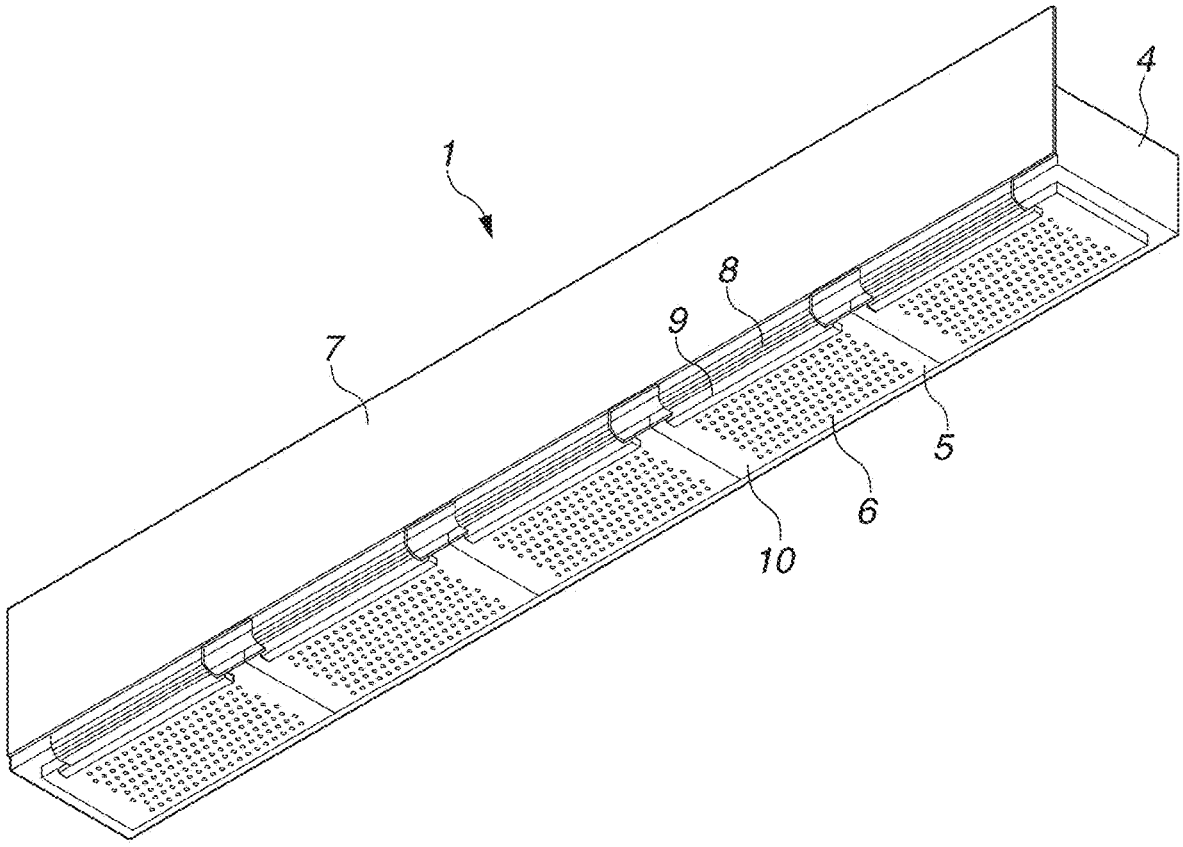
FIG. 2 is a perspective view illustrating an example liquid discharge head unit.

FIG. 2 illustrates a perspective view of the liquid discharge head unit 1 to which the present disclosure is applicable. The liquid discharge head unit 1 includes a plurality of liquid discharge heads 5 disposed adjacent to each other on a head main body 4. The liquid discharge head unit 1 is configured to be able to supply a liquid (ink) from a tank (not illustrated) of each color to the liquid discharge heads 5 via a common supply port (not illustrated) of the head main body 4. The liquid supplied to the liquid discharge heads 5 passes through flow passages inside them, and is discharged from discharge ports 6 to be supplied to the recording medium 2. Further, an electric wiring substrate 7 for supplying electric power and a signal necessary to discharge the liquid to the liquid discharge heads 5 is mounted on the head main body 4, and the liquid discharge heads 5 and the electric wiring substrate 7 are connected to each other via wiring members 8 each corresponding to a different one of the plurality of liquid discharge heads 5. FIG. 2 illustrates an example of the liquid discharge head unit 1, and the present disclosure is also applicable even to a different configuration.

(Example Liquid Discharge Head)

Figure 3A:
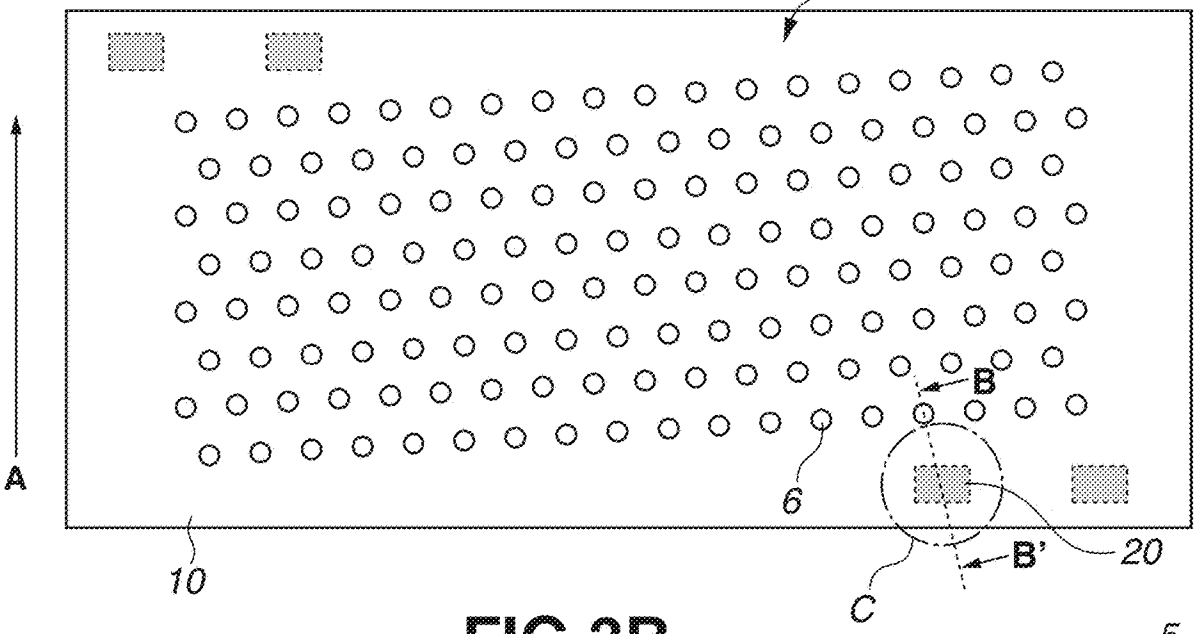
FIGS. 3A and 3B are schematic views illustrating an example liquid discharge head.
Figure 3B:
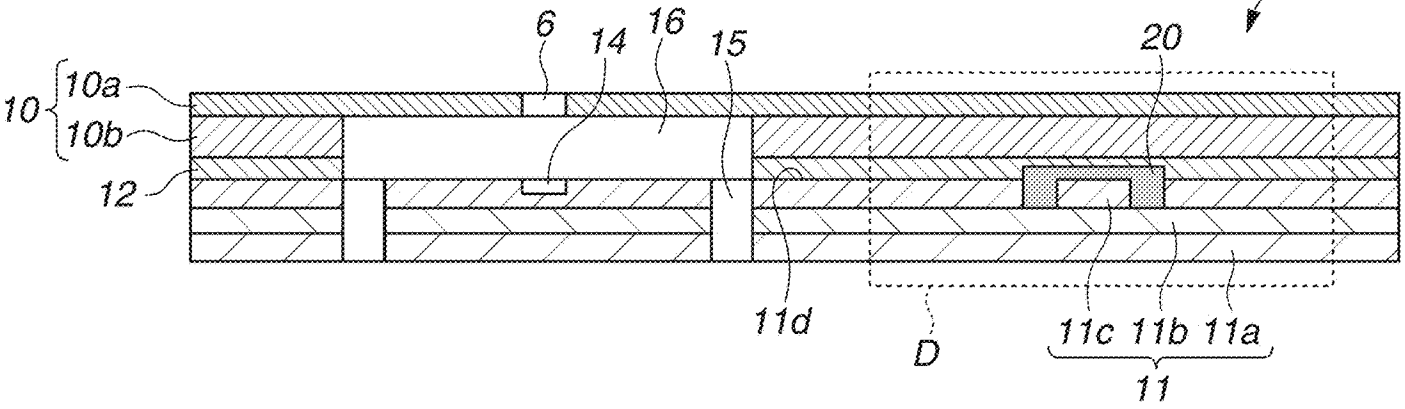

FIGS. 3A and 3B are schematic views of the liquid discharge head 5 according to the present example embodiment. FIG. 3A illustrates a plan view of the liquid discharge head 5, and FIG. 3B illustrates a cross-sectional view along a line B-B in FIG. 3A. FIG. 3A illustrates a flow passage forming member 10 partially transparently to indicate the position of a conductive member 20, which will be described below.

The liquid discharge head 5 includes the flow passage forming member 10 and the element substrate 11. The flow passage forming member 10 includes a flow passage through which the liquid flows, such as the discharge port 6 and a pressure chamber 16 in communication with the discharge port 6. The element substrate 11 includes a liquid discharge element 14, which applies energy to the liquid to cause the liquid to be discharged. The liquid discharge head 5 further includes an adhesion layer 12 as an intermediate layer disposed between the flow passage forming member 10 and the element substrate 11.

The liquid discharged from the plurality of discharge ports 6 on one liquid discharge head 5 is ink of the same color in the present example embodiment, but ink of a different color may be used for, for example, each discharge port row. Further, the discharged liquid may be liquid different from the ink. A common flow passage (not illustrated) through which the liquid flows extends in the element substrate 11, and this common flow passage is in communication with the pressure chamber 16 via each of a plurality of individual flow passages 15. While two individual flow passages 15 are disposed for one pressure chamber 16 in the present example embodiment, one individual flow passage 15 may be disposed for one pressure chamber 16. In the present example embodiment, a circulatory flow may be formed in such a manner that the liquid flows from the individual flow passage 15 on one side into the pressure chamber 16 and then the liquid flows out of the individual flow passage 15 on the other side.

The flow passage forming member 10 according to the present example embodiment includes a discharge port forming member 10*a*, on which the discharge port 6 is formed, and a partition wall member 10*b*, which includes a partition wall for forming the pressure chamber 16. However, the flow passage forming member 10 is not limited to such a configuration. The discharge port forming member 10*a* and the partition wall member 10*b* may be formed as an integrated member, and, the flow passage forming member 10 may include another member.

The partition wall member 10*b* is desirably made from a resin material, and further desirably made from a photosensitive resin material to form the flow passage such as the discharge port 6 and the pressure chamber 16 by light irradiation. Desirably, resin such as epoxy resin, acrylic resin, and urethane resin soluble in an organic solvent is used as the photosensitive resin. Examples of the epoxy resin include bisphenol A-type resin, cresol novolac-type resin, and circulatory epoxy resin. Examples of the acrylic resin include polymethyl methacrylate. Examples of the urethane resin include polyurethane.

An example of a method for forming the partition wall member 10*b* is a lamination method using a dry film. This lamination method is to form the partition wall member 10*b* on one side of the element substrate 11 where a surface 11*d* is located, by transferring a laminate of a dry film for forming the partition wall member 10*b* and a support body supporting it onto the one side of the element substrate 11 where the surface 11*d* is located, and peeling off the support body after that. In the present example embodiment, the adhesion layer 12 is formed on the surface 11*d* of the element substrate 11. When the partition wall member 10*b* is disposed by the lamination method on the surface 11*d* side of the element substrate 11 having a step formed by, for example, the adhesion layer 12, a void may be unintentionally formed due to failure to completely fill the step with the partition wall member 10*b*. It is desirable to carry out the transfer using the roller method that presses the laminate with a roller or carry out the transfer under vacuum to prevent the formation of such a void. Examples of the support body that supports the dry film include a film, a glass, and a silicon wafer, but use of the film is desirable in consideration of the later peel-off. Examples of the film as the support body include a polyethylene terephthalate (PET) film, a polyimide film, and a polyamide (aramid) film. Further, a release promotion treatment may be applied to the film to facilitate the peel-off.

The method for forming the partition wall member 10*b* is not limited to the above-described method, and resist spin coating, spraying application, slit coating, or the like can also be employed therefor.

The discharge port forming member 10*a* can also be made from a similar material to the partition wall member 10*b*, and can also be formed by using a similar formation method.

At a position corresponding to the discharge port 6 on the element substrate 11 according to the present example embodiment, a heating element that applies heat energy to the liquid to cause the liquid to foam and be discharged, as an example of the liquid discharge element 14, is disposed. The pressure chamber 16 including one liquid discharge element 14 therein is defined by the partition wall member 10*b*. The heating element as the liquid discharge element 14 generates heat to boil the liquid based on a pulse signal input via an internal wiring 23 (FIGS. 10A and 10B, which will be described below) laid inside the element substrate 11. The heating element causes the liquid to foam and be discharged from the discharge port 6 with the aid of this boiling. While the example using the heating element as the liquid discharge element 14 is described in the present example embodiment, an element utilizing the piezoelectric effect such as a piezoelectric element may be used as the liquid discharge element 14.

Desirably, the element substrate 11 is made of a material such as a semiconductor substrate on which an electronic device, such as the liquid discharge element 14, an electric circuit, an electric wiring, and a temperature sensor, can be formed by semiconductor processing, and a flow passage can be formed by micro electro mechanical system (MEME) processing. In the present example embodiment, layers 11*a* to 11*c* are laminated in this order from an opposite side from the flow passage forming member 10 on the element substrate 11. These layers 11*a* to 11*c* are, for example, disposed as layers containing silicon. For example, the layer 11*a*, the layer 11*b*, and the layer 11*c* can be disposed as a silicon substrate, an insulation layer made from silicon monoxide (SiO) or the like, and an insulation protection layer made from silicon nitride (SiN), silicon carbon nitride (SiCN), or the like covering the liquid discharge element 14, respectively. The configuration such as the laminate material and the number of layers of the element substrate 11 is not especially limited.

The adhesion layer 12 according to the present example embodiment is a layer for ensuring bondability between the flow passage forming member 10 (the partition wall member 10*b*) and the element substrate 11, and preventing separation between them. For example, a resin material such as polyether amide resin and epoxy resin can be used as the adhesion layer 12. However, the material of the adhesion layer 12 is not especially limited as long as the adhesion layer 12 is made from a material highly adhesive to both the layer 11*c* (the insulation protection layer in the present example embodiment) forming the surface 11*d* of the element substrate 11 and the flow passage forming member 10 and capable of improving the adhesion between them, and also stable toward the liquid. Examples of a method for forming the adhesion layer 12 include providing the adhesion layer 12 by applying a photosensitive resin material on the surface 11*d* of the element substrate 11 or by pressing a sheet made from a photosensitive resin material against the element substrate 11 using a roller.

A member made from a material different from the layer 11*c* may be disposed in a region where the adhesion layer 12 and the layer 11*c* forming the surface 11*d* of the element substrate 11 are in contact with each other due to restrictions regarding the arrangement of circuits and the like mounted on the element substrate 11. In the present example embodiment, the conductive member 20 made of a metallic material is disposed on the surface 11*d*, which is the surface of the element substrate 11 on the one side where the flow passage forming member 10 is disposed. This conductive member 20 contains, for example, at least any one of gold, tantalum, iridium, and the like, which are metallic materials used for the liquid discharge head 5. A bonding force between this conductive member 20 and the adhesion layer 12 made from the resin material such as the above-described examples is weak compared to a bonding force between the layer 11*c* of the element substrate 11 and the adhesion layer 12.

Figure 5A:
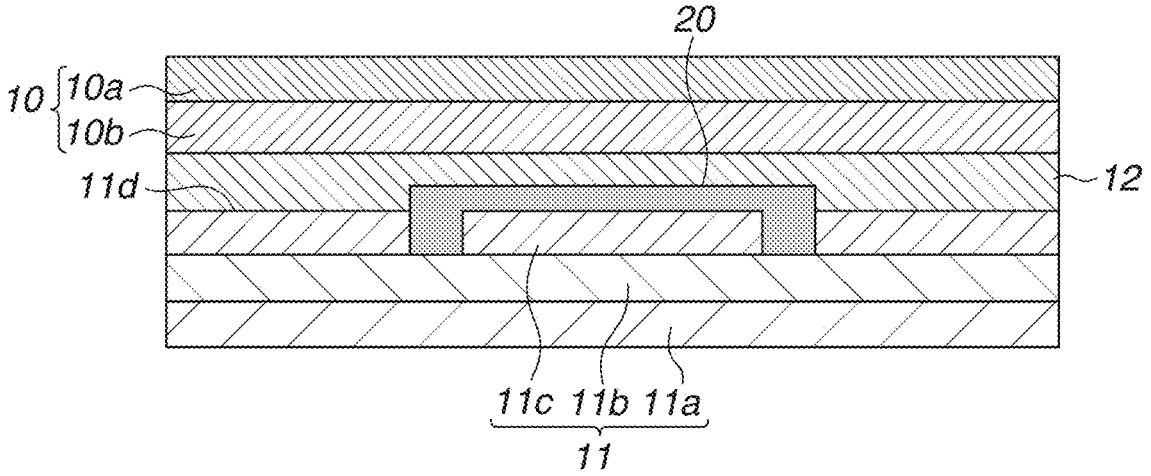
FIGS. 5A, 5B, and 5C are diagrams illustrating a part of a liquid discharge head according to a comparative example.
Figure 5B:
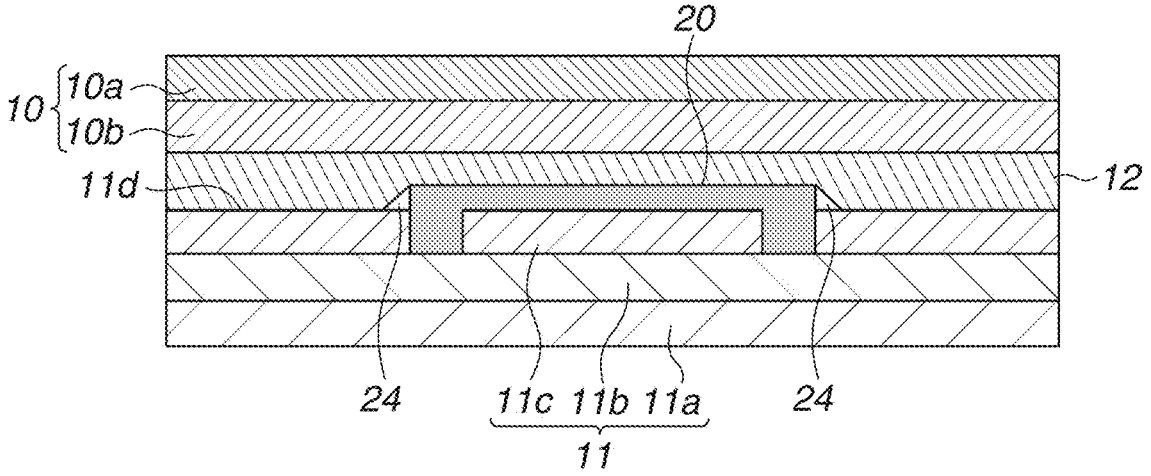
Figure 5C:
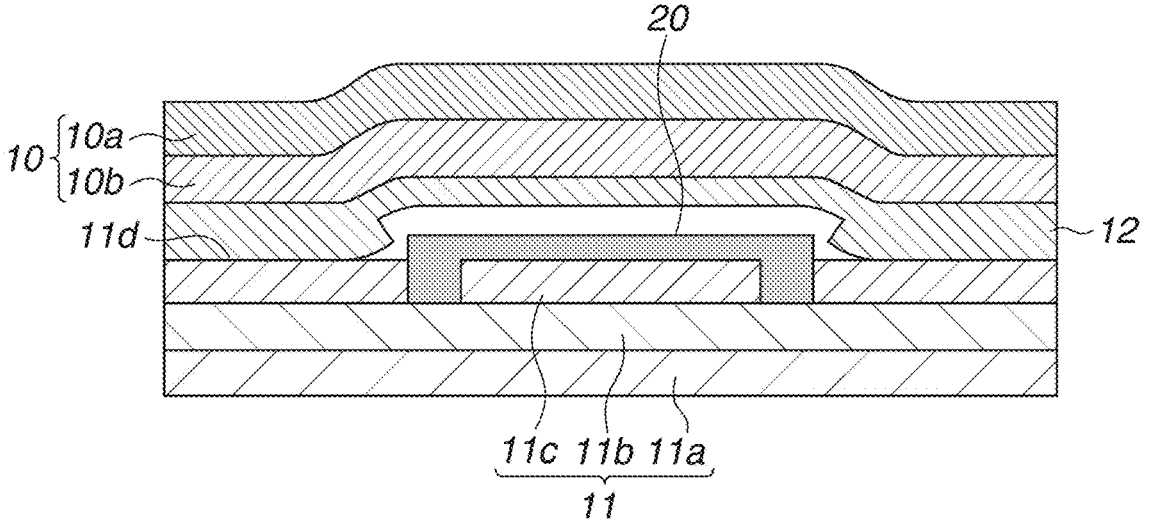

Next, a phenomenon that occurs near the conductive member 20 will be described with reference to FIGS. 5A, 5B, and 5C, which illustrate a part of a liquid discharge head according to a comparative example. FIGS. 5A, 5B, and 5C illustrate a portion surrounded by a broken line D in FIG. 3B.

As illustrated in FIG. 5A, the conductive member 20 protrudes toward the one side where the flow passage forming member 10 is located compared to the layer 11*c* forming the surface 11*d* of the element substrate 11. Then, on the adhesion layer 12 disposed on the surface 11*d* of the element substrate 11, an upper surface (a surface on the one side where the flow passage forming member 10 is disposed) and a side surface of the conductive member 20 are in contact with the adhesion layer 12. In other words, the conductive member 20 is covered with the adhesion layer 12. Then, in the case where the adhesion layer 12 is disposed by applying the photosensitive resin material on the surface 11*d* of the element substrate 11 or by pressing the sheet made from the photosensitive resin material against the element substrate 11 using the roller when the adhesion layer 12 is formed in the above-described manner, a void 24 may be formed. More specifically, in the above-described formation of the adhesion layer 12, a corner at a base of the conductive member 20 protruding from the surface 11*d* of the element substrate 11 is difficult to be filled, and the void 24 can be therefore formed due to failure to completely fill the corner with the adhesion layer 12 as illustrated in FIG. 5B.

FIG. 5C illustrates a state in which the flow passage forming member 10 and the adhesion layer 12 of the liquid discharge head according to the comparative example are swollen due to the liquid as time passes, and detachment between the members is developed near the conductive member 20. When the discharge port forming member 10*a*, the partition wall member 10*b*, and the adhesion layer 12 are in contact with the liquid along with the use of the liquid discharge head 5, they are swollen and expanded. When the adhesion force (the bonding force) between the materials is weaker than a force generated from this expansion, the materials are undesirably separated from each other and detachment between the members is developed. In the comparative example, the adhesion force between the adhesion layer 12 and the conductive member 20 is weaker than the force generated from the expansion, and therefore the adhesion layer 12 is separated from the conductive member 20 and the detachment is undesirably developed.

Due to the detachment of the adhesion layer 12 from the conductive member 20, the adhesion layer 12 may also be undesirably separated from the layer 11*c* near there (FIG. 5C). Especially, when the void 24 is formed as illustrated in FIG. 5B, a possibility that detachment is also developed between the layer 11*c* and the adhesion layer 12 from the void 24 serving as a starting point of the separation between the adhesion layer 12 and the conductive member 20 due to the swell. The influence of such the detachment advances as time passes, and may reach even as far as the pressure chamber 16, an end portion of the liquid discharge head 5, and the like, resulting in a large influence due to the detachment over the liquid discharge head 5. The reason why the element substrate 11, and the flow passage forming member 10 or the adhesion layer 12 are detached from each other is not limited to the above-described reason derived from the swell of the flow passage forming member 10 and the adhesion layer 12. Besides that, the detachment may occur due to a contact between, for example, a blade wiper for wiping the liquid on the surface where the discharge port 6 is formed and the flow passage forming member 10, heat generation at the time of, for example, the discharge of the liquid or a temperature adjustment, or the like.

Figure 4A:
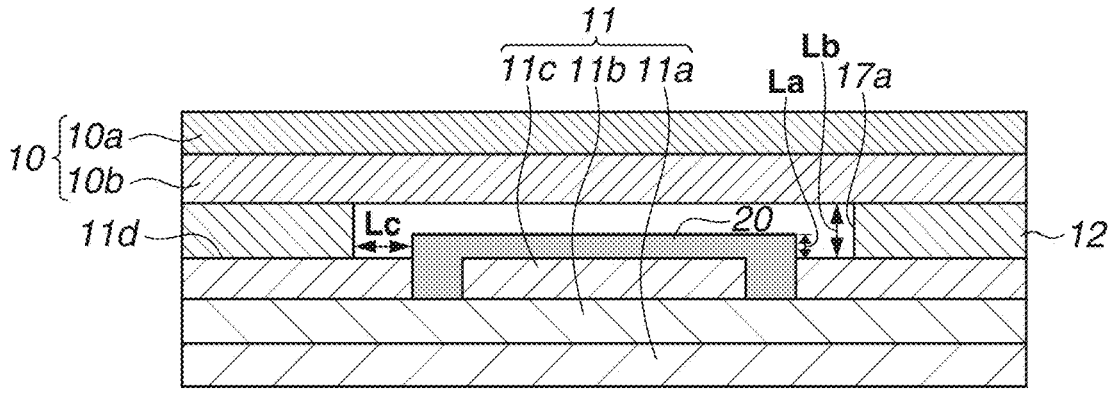
FIGS. 4A, 4B, and 4C are diagrams illustrating apart of the liquid discharge head according to a first example embodiment.
Figure 4B:
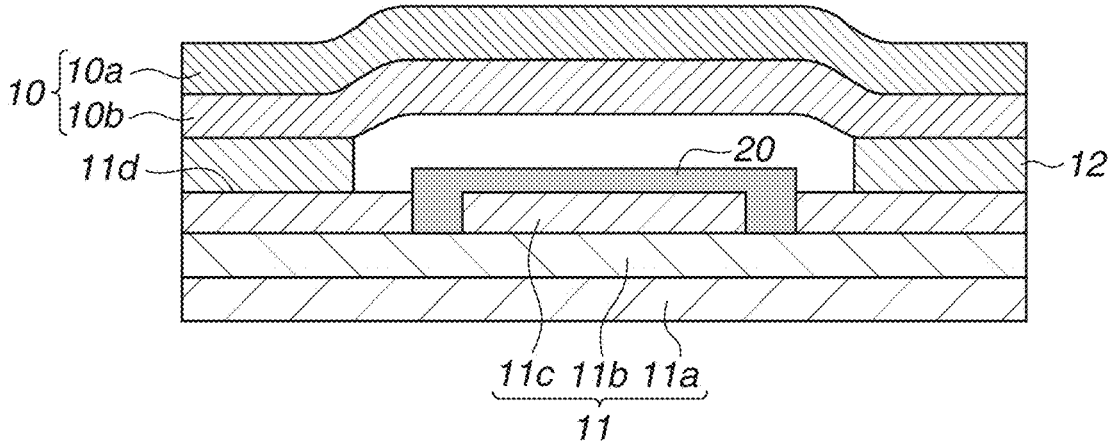
Figure 4C:
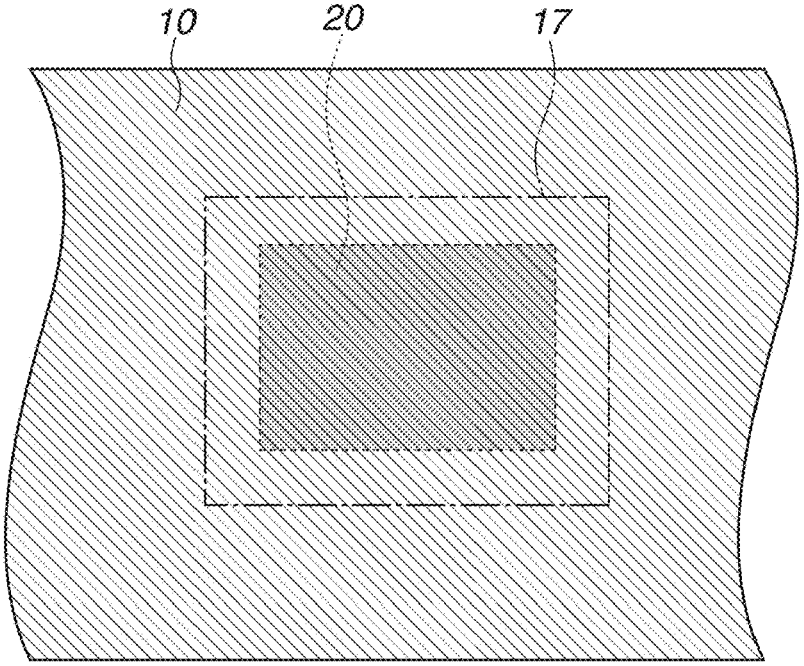

FIGS. 4A, 4B, and 4C illustrate a part of the liquid discharge head 5 according to the present example embodiment. FIG. 4A illustrates the portion surrounded by the broken line D in FIG. 3B. FIG. 4B illustrates a state in which the flow passage forming member 10 and the adhesion layer 12 are swollen as time passes in FIG. 4A. FIG. 4C illustrates a portion surrounded by a broken line C in FIG. 3A.

As illustrated in FIG. 4A, in the present example embodiment, the adhesion layer 12 disposed between the partition wall member 10*b* and the element substrate 11 is configured in such a manner that the adhesion layer 12 is partially removed and does not cover the conductive member 20 disposed on the surface 11*d* of the element substrate 11. In other words, the surface of the conductive member 20 and the adhesion layer 12 are kept in a state out of contact with each other. The liquid discharge head 5 is configured in such a manner that the conductive member 20 exposed from the adhesion layer 12 is covered with the flow passage forming member 10 (the discharge port forming member 10*a* and the partition wall member 10*b*). As illustrated in FIG. 4C, an opening portion 17 on the adhesion layer 12 is indicated by a broken line, and the conductive member 20 is exposed from this opening portion 17 and the flow passage forming member 10 is disposed above the exposed portion.

With this configuration, the adhesion layer 12 can be prevented from being detached due to separation of the adhesion layer 12 from the conductive member 20 even when the flow passage forming member 10 and the adhesion layer 12 are swollen as shown in FIG. 4B. Further, the conductive member 20 is covered with the flow passage forming member 10, and therefore can be protected from liquid.

Desirably, the adhesion layer 12 is disposed in such a manner that a wall 17*a* defining the opening portion 17 of the adhesion layer 12 and the conductive member 20 are separated from each other to reduce the number of locations that might develop as a starting point of detachment. Further, it is also desirable for the following reason that the adhesion layer 12 is kept in the state also out of contact with the side surface of the conductive member 20. That is, the present configuration can prevent the void 24 from being formed near the corner of the base of the conductive member 20 protruding from the surface 11*d* of the element substrate 11 due to failure of filling the void 24 with the adhesion layer 12 when the adhesion layer 12 is disposed on the surface 11*d* of the element substrate 11, whereby the influence of the detachment can be eliminated. Desirably, a width Lc of a gap between the wall 17*a* forming the opening portion 17 of the adhesion layer 12 and the conductive member 20 is approximately 10 μm to 20 μm. With this configuration, the void 24 can be prevented from being formed while a joined region is secured between the flow passage forming member 10 and the element substrate 11.

The conductive member 20 is also out of contact with the partition wall member 10*b* covering the conductive member 20, and there is a clearance around the conductive member 20 protruding from the surface 11*d* of the element substrate 11. Desirably, the surface of the liquid discharge head 5, i.e., the surface of the discharge port forming member 10*a* where the discharge port 6 is formed is shaped as a flat surface. To ensure flatness of the surface on which the discharge port 6 is formed, the liquid discharge head 5 may be configured in such a manner that the conductive member 20 and the partition wall member 10*b* are separated from each other like the present example embodiment.

The surface of the conductive member 20 (the surface on the side of the partition wall member 10*b*) is disposed on the surface 11*d* side of the element substrate 11 with respect to the surface of the adhesion layer 12 (the surface on the side of the partition wall member 10*b* side). In other words, a height of the protrusion of the conductive member 20 from the surface 11*d* of the element substrate 11, i.e., a length La of the conductive member 20 from the surface 11*d* in a direction perpendicular to the surface 11*d* is shorter than a thickness Lb of the adhesion layer 12 (a length in the perpendicular direction). For example, the height La of the protrusion of the conductive member 20 from the surface 11*d* of the element substrate 11 is approximately 0.4 μm, and the thickness Lb of the adhesion layer 12 is approximately 0.8 μm.

Figure 6:
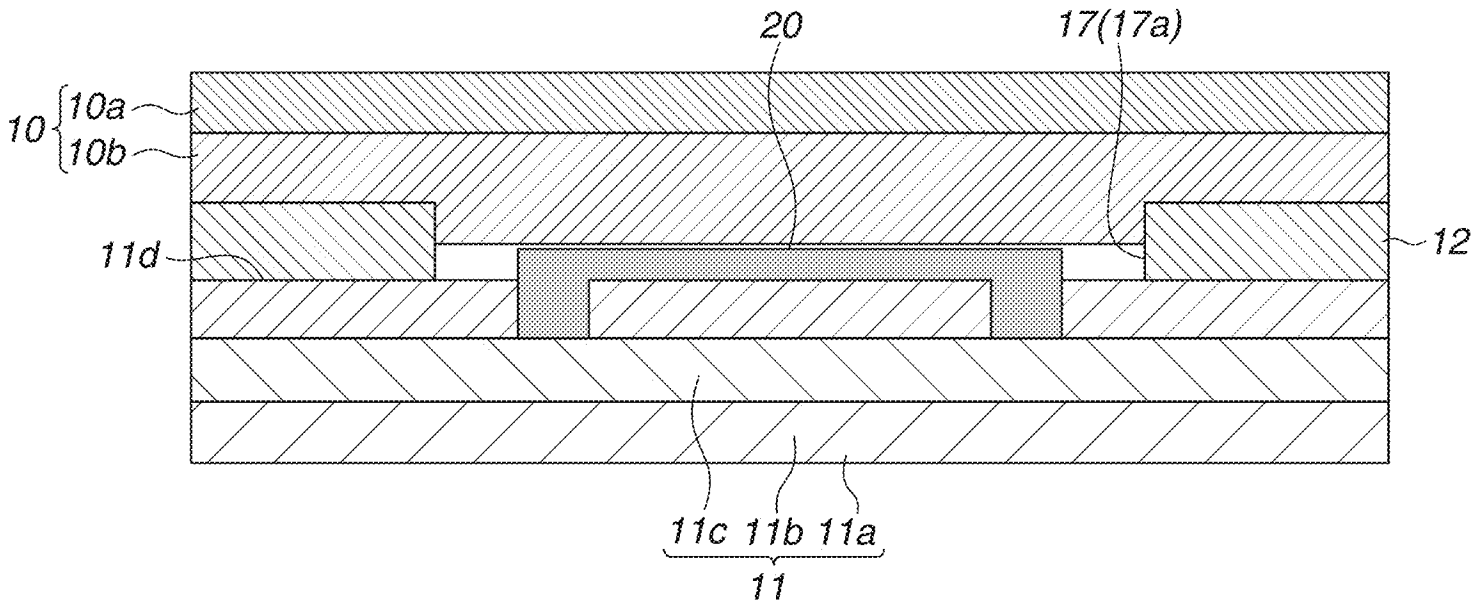
FIG. 6 is a diagram illustrating a part of a liquid discharge head according to a second example embodiment.

FIG. 6 illustrates a part of the liquid discharge head 5 according to a second example embodiment, and illustrates the present example embodiment in correspondence with FIG. 4A. In the present example embodiment, the conductive member 20 is not covered with the adhesion layer 12 but is covered with the flow passage forming member 10 similarly to the above-described example embodiment.

In the present example embodiment, the liquid discharge head 5 is configured in such a manner that the partition wall member 10*b* is fitted with the opening portion 17 of the adhesion layer 12 surrounding the conductive member 20. In other words, a distance between a portion of the partition wall member 10*b* that overlaps the opening portion 17 as viewed from the direction perpendicular to the surface 11*d* of the element substrate 11 and the conductive member 20 in the perpendicular direction is shorter than a distance between a portion of the partition wall member 10*b* that is joined to the adhesion layer 12 and the conductive member 20 in the perpendicular direction. Such a configuration is desirable for the following reason.

Depending on the materials of the discharge port forming member 10*a* and the partition wall member 10*b*, a heating treatment such as baking may be applied to cure these materials when the liquid discharge head 5 is manufactured. At the time of this heating treatment, air in the clearance around the conductive member 20 (the space surrounded by the adhesion layer 12, the element substrate 11, and the partition wall member 10*b*) is expanded. If a force derived from this expansion is stronger than the strength of the material, the expansion may cause, for example, a plastic deformation of the material. Therefore, in the present example embodiment, the partition wall member 10*b* is disposed in a manner such that the partition wall member 10*b* fits with the clearance, whereby the volume of the clearance around the conductive member 20 is reduced and thus the influence due to the expansion of the air is eased. The partition wall member 10*b* can fit with the clearance by, for example, adjusting a pressure on the partition wall member 10*b* against the element substrate 11 using the roller at mounting.

FIG. 6 illustrates the state in which the partition wall member 10*b* and the conductive member 20 are separated from each other, but the partition wall member 10*b* and the conductive member 20 may be separated from each other or may be in contact with each other. However, it is desirable that the partition wall member 10*b* fits in the clearance to such a degree that the partition wall member 10*b* and the conductive member 20 are still kept out of contact with each other to ensure the flatness of the surface of the discharge port forming member 10*a* on which the discharge port 6 is formed.

Figure 7A:
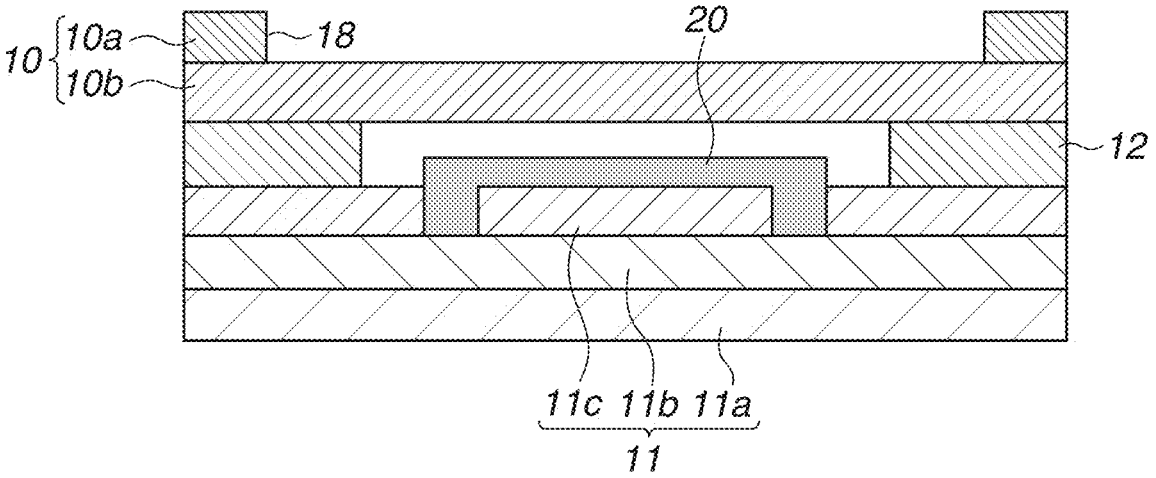
FIGS. 7A and 7B are diagrams illustrating a part of a liquid discharge head according to a third example embodiment.
Figure 7B:
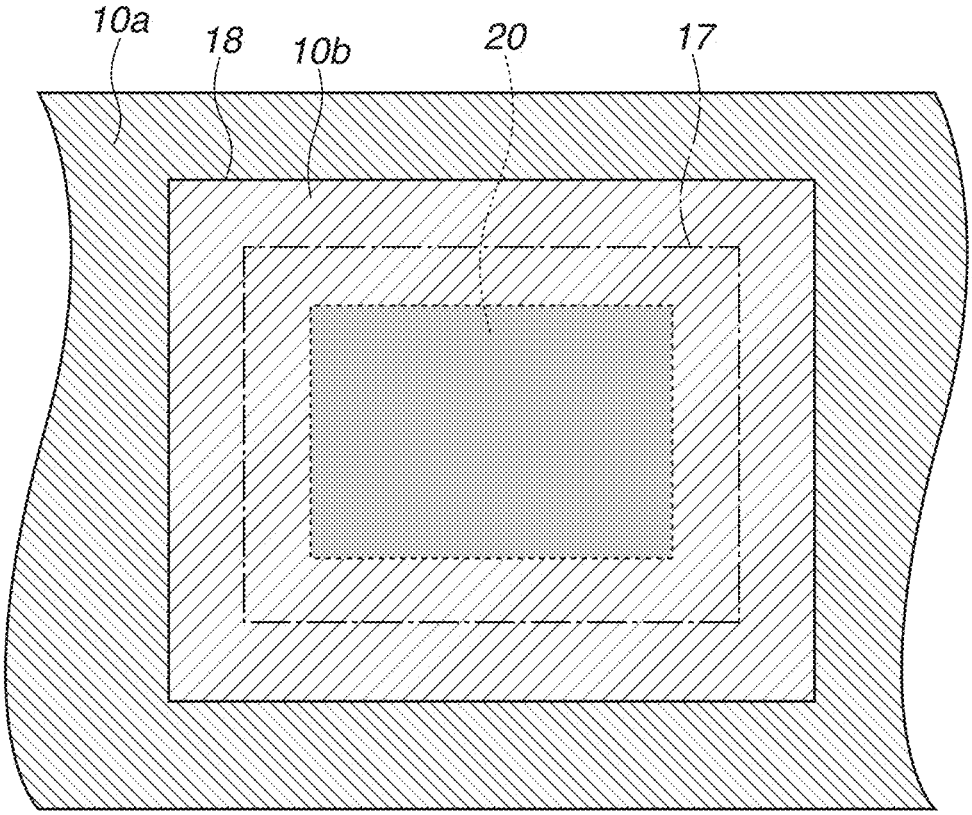

FIGS. 7A and 7B illustrate a part of the liquid discharge head 5 according to a third example embodiment. FIG. 7A illustrates the present example embodiment in correspondence with FIG. 4A, and FIG. 7B illustrates the present example embodiment in correspondence with FIG. 4C. In the present example embodiment, the conductive member 20 is not covered with the adhesion layer 12, too, similarly to the above-described example embodiments.

In the present example embodiment, the liquid discharge head 5 is configured in such a manner that the discharge port forming member 10*a* (a second member) above the conductive member 20 is removed and the conductive member 20 is covered only with the partition wall member 10*b* (a first member). More specifically, as illustrated in FIG. 7B, an opening portion 18 is disposed on the discharge port forming member 10*a* in such a manner that the opening portion 18 surrounds the opening portion 17 of the adhesion layer 12 as viewed from the direction perpendicular to the surface 11*d* of the element substrate 11. In this manner, the volume of the flow passage forming member 10 is reduced in the region around the conductive member 20 where the detachment would easily occur due to swell of the members resulting from contact with the liquid, by not providing the discharge port forming member 10*a* at the position overlapping the conductive member 20 as viewed from the perpendicular direction. With this configuration, the swell amount of the members resulting from contact with the liquid can be reduced in the liquid discharge head 5, whereby detachment between the flow passage forming member 10 and the element substrate 11 resulting from swell of the members can be further prevented. Desirably, the discharge port forming member 10*a* is removed as far as a region outside the opening portion 17 of the adhesion layer 12 to further reduce the swell amount.

Figure 8A:
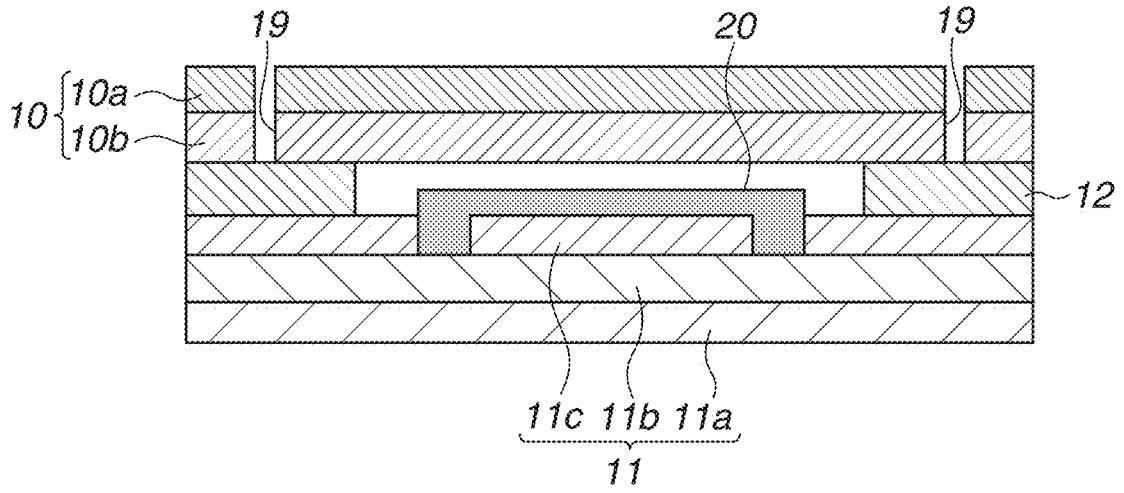
FIGS. 8A and 8B are diagrams illustrating a part of a liquid discharge head according to a fourth example embodiment.
Figure 8B:
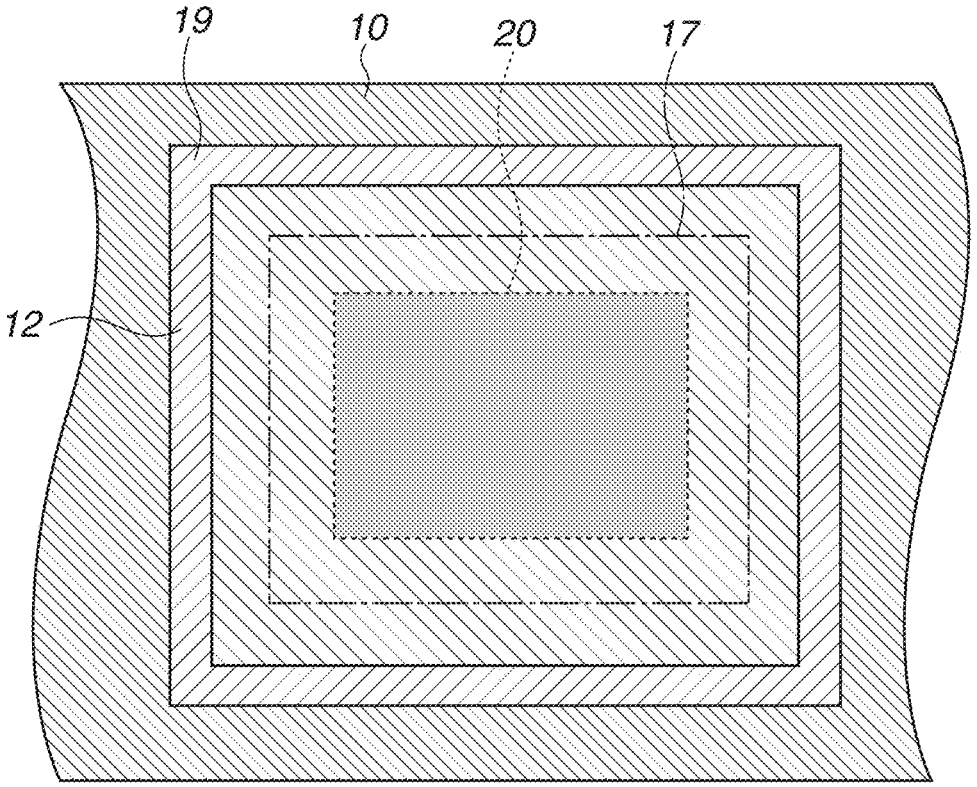

FIGS. 8A and 8B illustrate a part of the liquid discharge head 5 according to a fourth example embodiment. FIG. 8A illustrates the present example embodiment in correspondence with FIG. 4A, and FIG. 8B illustrates the present example embodiment in correspondence with FIG. 4C. In the present example embodiment, the conductive member 20 is not covered with the adhesion layer 12 but is covered with the flow passage forming member 10, too, similarly to the above-described example embodiments.

In the present example embodiment, the discharge port forming member 10*a* and the partition wall member 10*b* have a groove 19 in a region outside the portion overlapping the conductive member 20 as viewed from the direction perpendicular to the surface 11*d* of the element substrate 11, and the flow passage forming member 10 is divided by this groove 19 into an inner side and an outer side. The use of the liquid discharge head 5 raises a possibility of a contact with liquid anywhere on the surface where the discharge port 6 is formed, which means that there is a possibility that the discharge port forming member 10*a* and the partition wall member 10*b* are entirely swollen. When the members are expanded due to the swell, the force derived from this expansion is applied even to the region around the conductive member 20 where the adhesion layer 12 would be easily detached, which undesirably leads to detachment of the adhesion layer 12. The influence of expansion over the entire members can be reduced in the region around the conductive member 20 by providing the groove 19 and dividing the discharge port forming member 10*a* and the partition wall member 10*b* like the present example embodiment. As a result, detachment of the adhesion layer 12 can be prevented and separation between the flow passage forming member 10 and the element substrate 11 can be further prevented.

(Example of Application of Conductive Member)

A specific example of application of the conductive member 20 will be described. The configuration that will be described here is an example, and the conductive member 20 employable for the present disclosure is not limited to the following description.

Figure 9A:
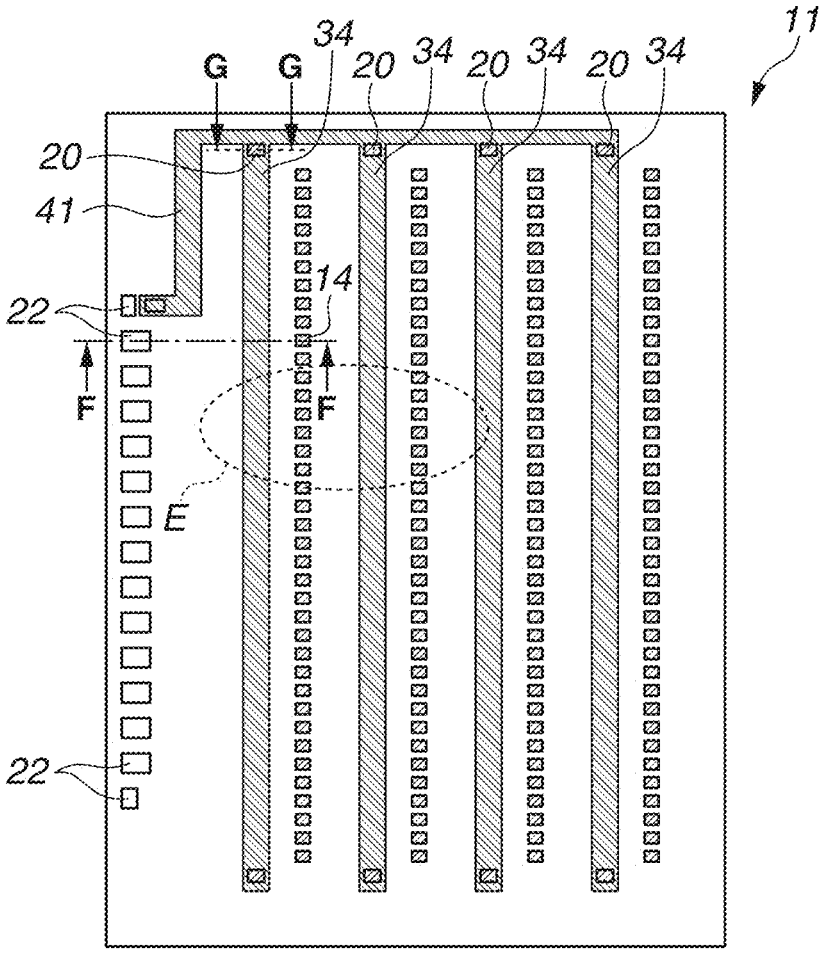
FIGS. 9A and 9B are diagrams illustrating an example of application of a conductive member.
Figure 9B:
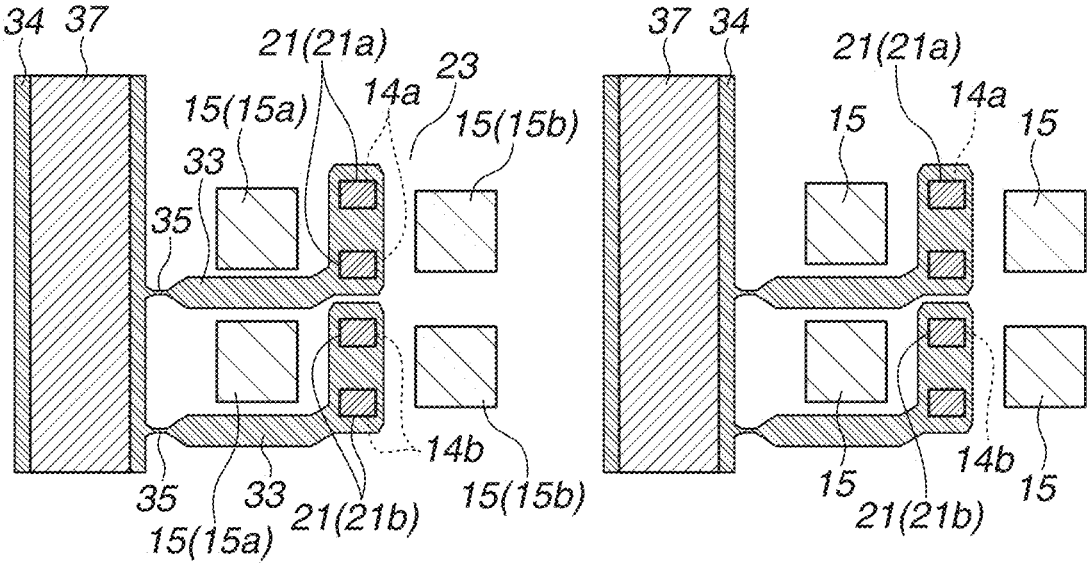

FIG. 9A illustrates a planar schematic view of the element substrate 11, and FIG. 9B illustrates a planar schematic view illustrating the inside of a region E indicated by a broken line in FIG. 9A in an enlarged manner. Further, FIG. 10A illustrates a cross-sectional view taken along a line F-F in FIG. 9A, and FIG. 10B illustrates a cross-sectional view taken along a line G-G in FIG. 9A.

Figure 10A:
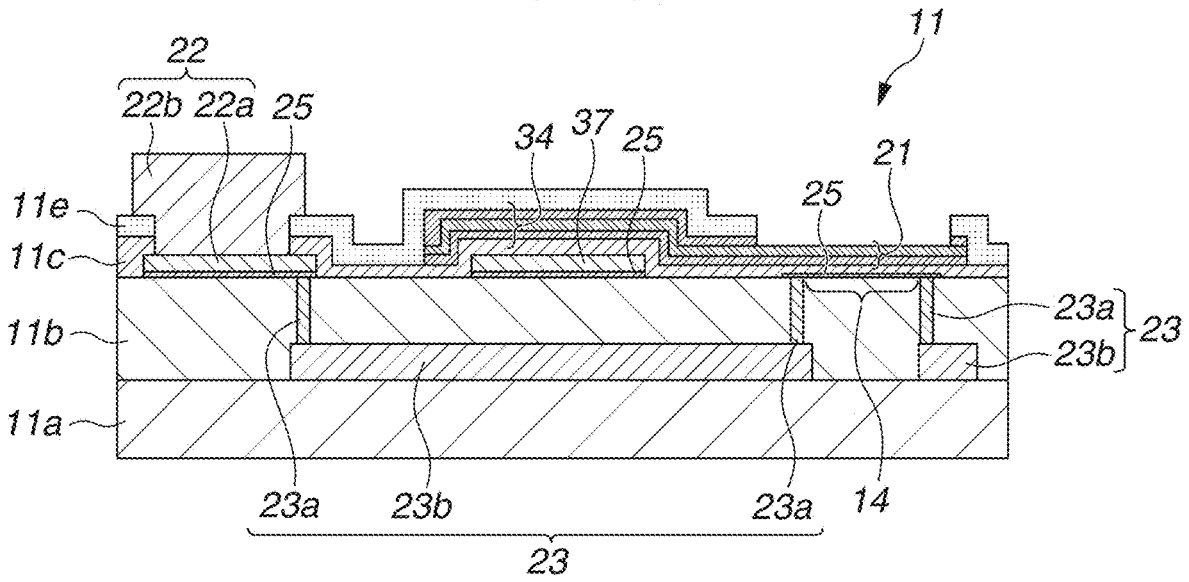
FIGS. 10A and 10B are diagrams illustrating the example of application of the conductive member.
Figure 10B:
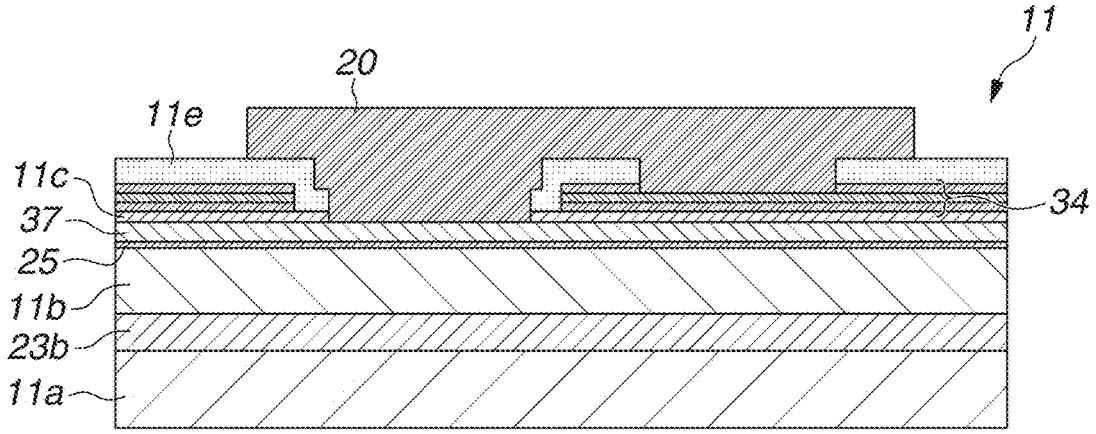

As illustrated in FIG. 10A, the liquid discharge element 14 includes a part of a heating resistance layer 25, and is connected to a terminal 22 for an electric connection to outside via an internal wiring 23 such as a plug 23*a* and a wiring 23*b*. The liquid discharge element 14 is covered with the insulation protection layer 11*c* made from SiN or the like and a protection layer 21 (a covering portion) for protecting the liquid discharge element 14 from cavitation. This protection layer 21 can be configured as, for example, a metallic film such as tantalum and iridium, or a laminate film constructed by laminating these metallic films as a plurality of layers. Further, a second intermediate layer 11*e* is disposed on the protection layer 21 on a surface side where the flow passage forming member 10 is disposed. This second intermediate layer 11*e* protects the insulation protection layer 11*c* from liquid, and can be formed from SiCN or the like.

As illustrated in FIG. 9B, the liquid discharge elements 14 are disposed between individual flow passages 15*a* and 15*b*. The pair of individual flow passages 15*a* and 15*b* is disposed for two liquid discharge elements 14. A plurality of individual flow passages 15*a* is disposed along a direction of the discharge port row (a direction in which the liquid discharge elements 14 are arrayed), and a plurality of individual flow passages 15*b* is also disposed along the direction of the discharge port row. The protection layer 21 covering the liquid discharge element 14 is connected to an individual wiring 33 passing through a beam portion between the adjacent individual flow passages 15*a*. A plurality of individual wirings 33 is electrically connected to a common wiring 34.

As illustrated in FIG. 9A, the common wiring 34 extends in the direction of each discharge port row (the row of the liquid discharge elements 14), and each common wiring 34 corresponds with a different one row of the liquid discharge elements 14. The common wiring 34 is disposed on the individual flow passage 15*a* side of the row of the liquid discharge elements 14. A plurality of common wirings 34 is arranged in a pectinate manner on the element substrate 11, and the plurality of common wirings 34 is connected to the terminal 22 via a terminal connection wiring 41. Some of the common wirings 34 are disposed between the rows of the liquid discharge elements 14.

As illustrated in FIG. 9B, the common wiring 34 and the individual wiring 33 are connected to each other via a fuse portion 35 disposed therebetween. More specifically, the common wiring 34 is electrically connected to the protection layer 21 (a first covering portion 21*a*) covering the liquid discharge element 14 (a first liquid discharge element 14*a*) and the protection layer 21 (a second covering portion 21*b*) covering another liquid discharge element 14 (a second liquid discharge element 14*b*). The fuse portion 35 is disposed in each of current paths between the common wiring 34 and the plurality of protection layers 21. To reduce a manufacturing load, the individual wiring 33, the common wiring 34, and the fuse portion 35 desirably have similar laminate structures, and further desirably have laminate structures in common with at least a part of layers of the protection layer 21.

When an accidental failure has occurred and conductivity is established between the liquid discharge element 14 and the protection layer 21 covering the liquid discharge element 14, a current flows from the liquid discharge element 14 to the fuse portion 35 by passing through the protection layer 21, by which the fuse portion 35 is blown. As a result, the protection layer 21 conductively connected to the liquid discharge element 14 can be electrically isolated from the common wiring 34, and thus an influence of alteration of the property of the protection layer 21 to be exerted on the protection layer 21 covering another liquid discharge element 14 can be prevented.

The width of the fuse portion 35 is narrower than the width of the individual wiring 33. The fuse portion 35 is therefore to be melted when a current flows from the liquid discharge element 14 to the terminal 22. The width of the fuse portion 35 should satisfy a processing dimension of several μm or narrower, and is desirably set to 3 μm or narrower to ensure the ability to blow.

In the present example embodiment, one fuse portion 35 is disposed for the protection layer 21 covering the two liquid discharge elements 14. How the liquid discharge element 14 and the fuse portion 35 are combined may be determined based on a configuration in which, when an accidental failure has occurred in the liquid discharge element 14, another liquid discharge element 14 can complement it.

However, some of the common wirings 34 are disposed between the adjacent rows of the liquid discharge elements 14 as described above. For this reason, reducing an interval between the adjacent rows of the liquid discharge elements 14 to reduce the size of the element substrate 11 leads to the necessity of also reducing the width of the common wiring 34 disposed between these rows. Consequently, wiring resistance of the common wiring 34 is increased. Further, in a case where the liquid discharge head 5 includes a large number of discharge ports 6 (the liquid discharge elements 14) and includes a long discharge port row (a heating resistance element row), the wiring resistance of the common wiring 34 increases at the fuse portion 35 having a long distance from the terminal 22 to the fuse portion 35 via the common wiring 34 among the plurality of fuse portions 35. The increase in the wiring resistance of the common wiring 34 in this manner may cause a low current to flow to the fuse portion 35, which may result in a failure to allow the fuse portion 35 to blow.

Therefore, in the present example embodiment, a wiring 37 is disposed in a layer different from a layer of the common wiring 34 in the lamination direction (the direction perpendicular to the surface 11*d* of the substrate 11) (FIG. 9B). Further, the common wiring 34 and the wiring 37 are electrically connected to each other via a plurality of electric connection portions 20 (the conductive member 20) penetrating through the insulation protection layer 11*c* (FIG. 10B). Then, each of the plurality of electric connection portions 20 is disposed between the terminal 22 and the fuse portion 35 in the path of the current passing through the common wiring 34, and connects the common wiring 34 and the wiring 37 in parallel. With this configuration, the wiring resistance in the path of the current between the terminal 22 and the fuse portion 35 (FIG. 9A) is reduced. As a result, a voltage drop in the common wiring 34 can be prevented, and a reduction in the current amount flowing to the fuse portion 35 can be prevented, whereby the ability to blow of the fuse portion 35 can be ensured. In other words, when the conductivity is established between the liquid discharge element 14 and the protection layer 21, the current transmitted from the liquid discharge element 14 can flow while passing through the wiring 37, whereby the fuse portion 35 can blow easily. Therefore, when the conductivity is established between the liquid discharge element 14 and the protection layer 21, the influence over the protection layer 21 covering the other liquid discharge elements 14 can be prevented.

As illustrated in FIG. 10B, the common wiring 34 and the wiring 37 are connected to each other via the electric connection portion 20. This electric connection portion 20 connects a surface of an iridium layer exposed by removal of a tantalum layer on a front layer side of the common wiring 34 and the second intermediate layer 11*e*, and a surface of the wiring 37 exposed by removal of the insulation protection layer 11*c* and the second intermediate layer 11*e* to each other. In other words, the electric connection portion 20 is disposed to connect the back surface side of the surface of the common wiring 34 facing the wiring 37 and the surface of the wiring 37 facing the common wiring 34 to each other. The electric connection portion 20 is made from the same material as a terminal forming layer 22*b* forming a part of the terminal 22 illustrated in FIG. 10A and is configured as a layer in common with the terminal forming layer 22*b* to reduce the manufacturing load. For example, the electric connection portion 20 and the terminal forming layer 22*b* are configured as a laminate film including a layer made from gold on the front surface side and a tungsten-titanium (TiW) layer disposed below the golden layer as barrier metal. By disposing the electric connection portion 20 as the same layer level as the terminal 22 mounted on the front surface side of the element substrate 11 in this manner, the electric connection portion 20 is established on the front surface side of the element substrate 11. Therefore, the liquid discharge head 5 is configured in such a manner that the electric connection portion 20 is covered with the flow passage forming member 10 like the above-described example embodiments to protect the electric connection portion 20 (the conductive member 20) from the liquid. The terminal 22 is connected to the wiring member 8 outside the liquid discharge head 5. Therefore, at least a part of the terminal 22 is not covered with, for example, the flow passage forming member 10, and is covered with a sealing material 9 (FIG. 2) after being connected to the wiring member 8, unlike the electric connection portion 20. Meanwhile, the electric connection portion 20 is the member disposed on the way of the electric path in the internal wiring of the element substrate 11, and therefore can be configured to be covered with the flow passage forming member 10. Further, the electric connection portion 20 is disposed near the liquid discharge element 14 and the discharge port 6 compared to the terminal 22, and therefore it is desirable to cover the region around the electric connection portion 20 with the flow passage forming member 10 to protect the electric connection portion 20 from the liquid.

Further, desirably, a terminal forming layer 22*a* and the wiring 37 are provided as a common layer made from the same material such as aluminum (Al), or the like to reduce the manufacturing load. FIG. 10A illustrates the terminal 22 electrically connected to the liquid discharge element 14, but the terminal 22 electrically connected to the common wiring 34 also has a similar laminate structure, and the terminal forming layer 22*a* and the terminal forming layer 22*b* are laminated therein.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2019-072251, filed Apr. 4, 2019, which is hereby incorporated by reference herein in its entirety.

What is claimed is:

1. A liquid discharge head comprising:

a flow passage forming member that is made from a resin material and forms a flow passage in communication with a discharge port;

an element substrate including a liquid discharge element configured to discharge a liquid from the discharge port, and a surface, on a side where the flow passage forming member is disposed, on which a conductive member made from a metallic material is disposed; and an intermediate layer made from a resin material and configured to join the flow passage forming member and the surface of the element substrate to each other, wherein the intermediate layer is disposed in a state, separated from the conductive member, where the conductive member is exposed from the intermediate layer, and wherein the conductive member is covered with the flow passage forming member.

2. The liquid discharge head according to claim 1, wherein the conductive member protrudes from the surface of the element substrate, and wherein a length of the conductive member from the surface in a direction perpendicular to the surface of the element substrate is shorter than a length of the intermediate layer from the surface of the element substrate in the perpendicular direction.

3. The liquid discharge head according to claim 1, wherein the conductive member is exposed via an opening portion of the intermediate layer, as viewed from a direction perpendicular to the surface of the element substrate.

4. The liquid discharge head according to claim 3, wherein the conductive member and a wall forming the opening portion of the intermediate layer are separated from each other.

5. The liquid discharge head according to claim 3, wherein a distance between a portion of the flow passage forming member that overlaps the opening portion and the conductive member in the perpendicular direction is shorter than a distance between a portion of the flow passage forming member that is joined to the intermediate layer and the conductive member in the perpendicular direction, as viewed from the perpendicular direction.

6. The liquid discharge head according to claim 1, wherein the flow passage forming member and the conductive member are separated from each other.

7. The liquid discharge head according to claim 1, wherein the flow passage forming member includes a first member joined to the intermediate layer, and a second member disposed on an opposite side of the first member from the intermediate layer, and wherein the conductive member is covered with the first member, and the conductive member and the second member do not overlap each other, as viewed from a direction perpendicular to the surface.

8. The liquid discharge head according to claim 1, wherein the flow passage forming member has a groove in a region outside a portion overlapping the conductive member, as viewed from a direction perpendicular to the surface, and the flow passage forming member is divided at the groove.

9. The liquid discharge head according to claim 1, wherein a portion of the element substrate that is joined to the intermediate layer contains silicon.

10. The liquid discharge head according to claim 1, wherein the intermediate layer contains polyether amide resin or epoxy resin.

11. The liquid discharge head according to claim 1, wherein the conductive member contains at least any one of gold, tantalum, and iridium.

12. The liquid discharge head according to claim 1, wherein a bonding force between the intermediate layer and the conductive member is weaker than a bonding force between the intermediate layer and the surface of the element substrate.

13. The liquid discharge head according to claim 1, wherein the element substrate includes a terminal for a connection to outside, and a wiring electrically connected to the terminal and disposed inside the element substrate, and wherein the conductive member is electrically connected to the terminal via the wiring.

14. The liquid discharge head according to claim 13, wherein the terminal is provided on the surface of the element substrate, and the terminal and the conductive member are made from a common material.

15. The liquid discharge head according to claim 13, wherein at least a part of the terminal is not covered with the flow passage forming member.

* * * * *